United States Patent [19]

Lindquist

[11] 4,363,280

[45] Dec. 14, 1982

[54] SEWING MACHINE ATTACHMENTS

[75] Inventor: Carl Lindquist, Lake Ariel, PA

[73] Assignee: Pennsylvania Sewing Research Corp., Lake Ariel, Pa.

[21] Appl. No.: 176,914

[22] Filed: Aug. 11, 1980

[51] Int. Cl.[3] ..... D05B 3/18

[52] U.S. Cl. ..... 112/105; 112/235

[58] Field of Search ..... 112/105, 107, 104, 235, 112/240, 114

[56] References Cited

U.S. PATENT DOCUMENTS 2,991,739 7/1961 Joa ..... 112/235

3,143,092 8/1964 Glassman et al. ..... 112/105

3,415,210 12/1968 Glassman ..... 112/114

*Primary Examiner*—Peter P. Nerbun

[57] ABSTRACT

Sewing machine attachment comprises a substantially horizontally extending positioning member having an open cavity therein, at least a portion of the cavity walls defining a seat for a magnetizable accessory and magnetic means within the positioning member for producing a magnetic flux which extends from the seat through the opening to the cavity for attracting the accessory. At least a portion of one wall of the cavity, preferably the bottom wall, is removably mounted on the positioning member.

7 Claims, 3 Drawing Figures

SEWING MACHINE ATTACHMENTS

BACKGROUND OF THE INVENTION

This invention relates to a novel sewing machine attachment and, particularly, to an attachment for holding an accessory, such as a hook or an eye, in a predetermined position for sewing. The sewing machine or stitch-forming machine used for the novel attachment hereinafter described is of the type generally used to secure buttons, hooks or other fasteners to fabric or other pliable web material.

U.S. Pat. No. 3,143,092 issued Aug. 4, 1964 to A. Glassman et al discloses a sewing machine attachment for use in locating and holding a magnetizable accessory in a predetermined position for sewing on a sewing machine. That attachment comprises generally (a) a substantially horizontally-extending positioning member having an open cavity therein wherein at least a portion of the walls of the cavity defines a seat for an accessory and (b) magnetic means within the positioning member for producing a magnetic flux which extends from said seat through the opening in the cavity. U.S. Pat. No. 3,415,210 issued Dec. 10, 1968 to A. Glassman discloses another such sewing-machine attachment.

Previously, the horizontally-extending positioning member was made by milling out a deep groove in a block of brass or other nonmagnetic material and then soldering a plate to the block thereby forming the cavity in which the plate is the bottom major wall of the cavity. In use, the plate is the most frequent site of failures. For example, while sewing, when the needle strays from its normal path of travel, it often strikes the accessory whereby it pushes down causing the solder joint to rupture and the plate to burst away from the attachment.

Another problem with the prior attachment is that dust and foreign particles accumulate in the cavity and are compacted at the back of the cavity adjacent the source of magnetic flux. The compacted debris interferes with the operation of the attachment and often prevents the accessory from seating properly. The prior attachment is provided with a clean-out hole which can be used for removing the debris from the cavity by poking with a wire or other elongated object. While this procedure provides some relief, it is time consuming and is not practiced frequently enough, so that the problem persists and hampers the effective usage of the attachment.

SUMMARY OF THE INVENTION

The novel attachment, as in prior attachments, comprises a substantially horizontally-extending positioning member having (a) an open cavity therein, at least a portion of the cavity walls defining a seat for a magnetizable accessory, and (b) magnetic means within the positioning member for producing a magnetic flux which extends for the seat through the opening of the cavity. Unlike prior attachments, at least a portion of one wall of the cavity is removably mounted (instead of fixedly mounted) on the positioning member. In a preferred form of the attachment, the cavity is defined by two major horizontally-extending walls. At least a portion of one of the major walls, preferably the bottom major wall, is a plate that is removably mounted on the positioning member. The plate may be rectangular with two opposite sides that are angularly shaped to a dovetail and are adapted to mate with dovetailed slots in the positioning member. To improve the fit of the plate in the slots without increasing the mechanical stress in the walls defining the slots, it is desirable to provide a slit aperture in the plate closely spaced from and substantially parallel to one of the angularly-shaped sides.

DETAILED DESCRIPTION OF THE PREFERRED EMBODIMENT

Figure 1:
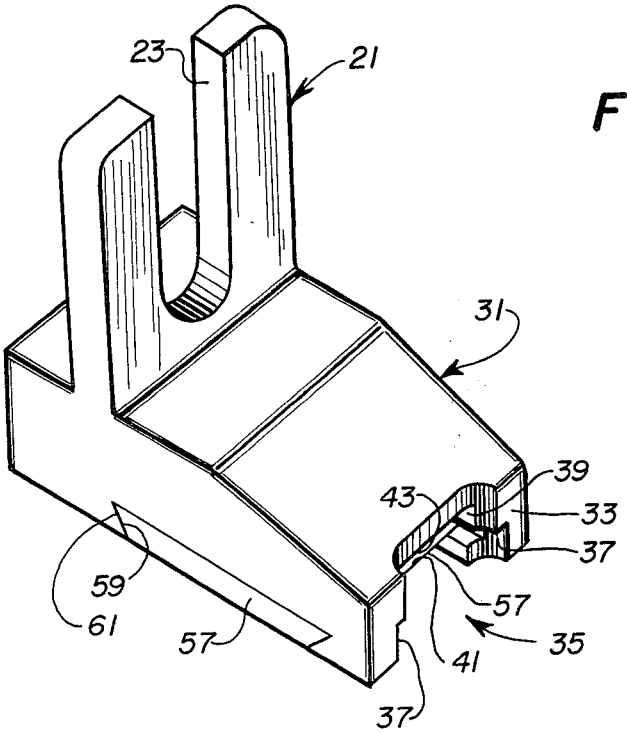
FIG. 1 is a perspective view of a preferred embodiment of the novel attachment adapted for positioning either a hook or an eye.
Figure 2:
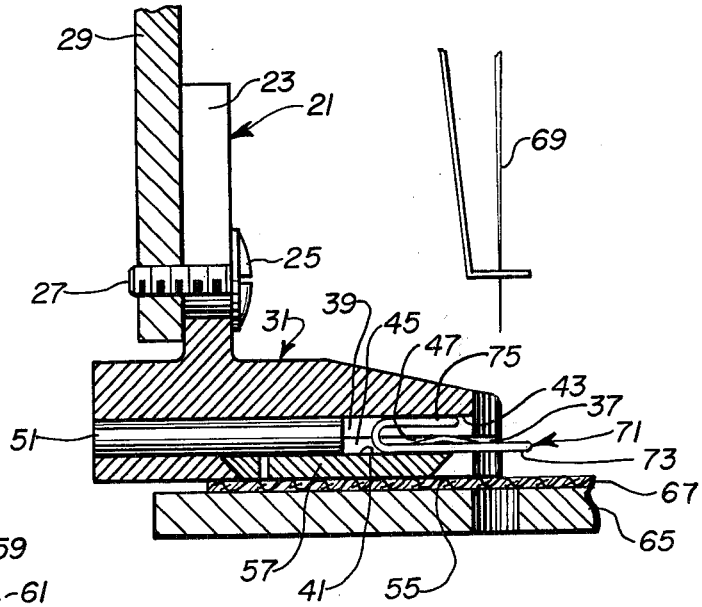
FIG. 2 is a sectional elevational view of the embodiment of FIG. 1 in position prior to stitching a hook to fabric.
Figure 3:
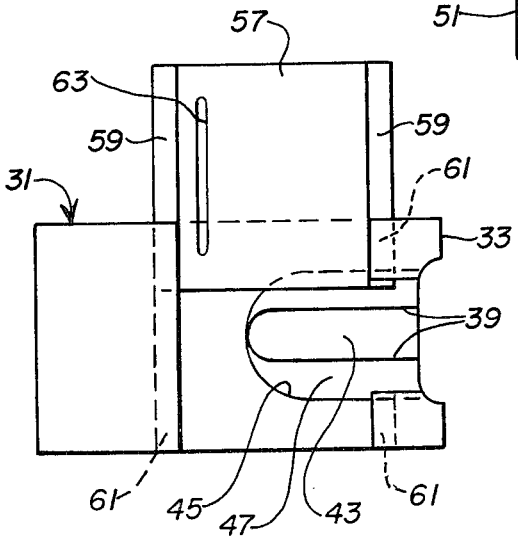
FIG. 3 is a bottom view of the embodiment of FIG. 1 showing the dovetailed plate positioned so that the cavity is partially opened.

FIGS. 1, 2 and 3 illustrate a preferred embodiment of the invention. The embodiment is a unitary structure having an L shape with an overall height (vertical dimension) of about 1.25 inches, an overall length (horizontal dimension) of about 1.25 inches, and a width of about 0.75 inch. All of the portions of the attachment are of a nonmagnetic material such as brass, copper, plastic or ceramic, except as otherwise indicated.

A vertically-extending shank portion 21 of the embodiment is about 0.25 inch long (horizontal dimension) and has a vertical slot 23 therein extending downward from the upper end thereof for attaching the shank portion 21 to a stationary portion 29 on a sewing machine as shown in FIG. 2. For attachment, the shank portion 21 is slipped under a screw head 25 of a screw 27 in the slot 23, the attachment is positioned as desired, and the screw 27 tightened.

The horizontally-extending positioning portion 31, also referred to as the foot of the embodiment, is about 0.31 inch high and about 1.25 inches long (horizontal dimension). The positioning portion or foot 31 is attached to the lower end of the shank portion 21 and is preferably integral with the shank portion 21. The other extended end 33 of the positioning portion 31 has an open definitely-shaped cavity 35 therein adapted to receive either a hook or an eye of the type which has a pair of adjacent eyelets at one end thereof through which the thread passes for stitching the hook or eye to fabric. The opening to the cavity 35 is formed in part by two opposed curved or arcuate surfaces 37 arranged to receive the outer opposed curved surfaces of the eyelets of an accessory such as a hook or an eye. The extended end of the foot 31 curves inwardly so that the foot 31 is clear of the stitching needle 69 and of the stitches formed by the sewing machine. The adjacent eyelets extend beyond the cavity and under the stitching needle 69.

The cavity includes also a first pair of parallel spaced vertical walls 39, a horizontal floor 41, and a first horizontal roof 43 extending inwardly of the foot 31 adapting the foot 31 to receive the hook portion 75 of the hook 71 as illustrated in FIG. 2. The cavity 35 includes also a second pair of parallel spaced vertical walls 45, the horizontal floor 41, and a second horizontal roof 47 extending inwardly of the foot 31 adapting the foot 31 to receive the eye portion 73 of an eye (not shown).

A small cylindrical permanent magnet 51 is fixed within the foot 31 and axially aligned with the cavity 35 and extends from the most inward portion of the cavity 35 to the end of the foot 31 which joins the shank 21. The magnet 51 may be positioned in the foot by pressing it into a small cylindrical hole bored in the desired position for that purpose. The magnet may be held in the hole by a press-fit, by adhesive, or by other suitable arrangement. The magnet 51 is magnetized so that a magnetic field (also referred to as magnetic flux) extends through the opening to the cavity 35. The magnet 51 may be magnetized either before or after insertion into the foot 31. The magnet 51 may be of any of the known permanent magnet materials, but is preferably of an aluminum-nickel-cobalt alloy, generally known as alnico.

The foot 31 also may have a transverse hole (not shown) extending across the width of the foot 31 at the most inward portion of the cavity 35. It has been found that dust, lint, and other fine material tend to accumulate at the most inward portion of the cavity at the end of the magnet 51. The hole provides an access through which this undesirable material may be removed, as by blowing with air.

A portion of the horizontal floor 41 of this embodiment of the novel attachment is a rectangular plate 57 which is removably mounted or detachably mounted on the horizontally-extending positioning member 31. This mounting is to be compared with the prior attachments mentioned above in which the horizontal floor and bottom wall of the cavity 35 is integral with or fixedly mounted to the positioning member 31. As shown in FIGS. 1, 2 and 3, the plate 57 has two opposite sides 59 that are angularly shaped to a dovetail. Also, the bottom of the positioning member 31 has two opposed slots 61 therein that are adapted for mating with the dovetailed sides 59 of the plate 57. As shown, the plate 57 is introduced into the slots 59 from the side of the attachment and slid into place, thereby providing the bottom wall and floor of the cavity. If it is desired to clean out debris from the cavity, the plate 57 may be slid partially or completely out of the slots 59, and any debris therein can be removed since the cavity is now easily accessible for cleaning. When cleaning is completed, the plate 57 is slid back into place.

It is desirable to provide a slit aperture 63 that extends through the plate 57. The slit aperture 63 is closely spaced from and parallel to one of the opposite angularly-shaped sides 59 of the plate 57. The slit aperture 63 which is about 4 mm (10 mils) wide defines a band 65 of plate material which provides a spring effect into the plate 57. This spring effect allows a wider tolerance in the width of the plate 57 while still providing adequate pressure on the dovetailed slots 61 to keep the plate 57 securely in place.

In operation, the shank portion 21 is positioned and attached to the stationary portion of a sewing machine below the needle 69 as previously described. A hook 71 (or an eye) is held close to the open end of the cavity 35 in the desired orientation. The magnetic flux, which extends from the magnet 51 through the open end of the cavity 35, draws the hook 71 (or an eye) into the cavity 35 and holds it therein with the outer opposed curved surfaces of the eyelets 73 bearing against the arcuate spaced walls 37 of the cavity 35. A piece of fabric 63 is positioned on a table 65 below the needle 61. The attachment is now moved downwardly so that the bottom of the foot 31 rests on the fabric 67. The needle 61 now stitches the hook 71 (or the eye) to the fabric 67 by alternate motion into each eyelet 73. The attachment is now moved upwardly and the fabric 63 with the hook 79 (or the eye) stitched thereto is removed and the process repeated.

The horizontally-extending foot portion 31 and the shank portion 21 may be perpendicular to one another. It has been found advantageous, however, to make the angle therebetween slightly greater than 90°, preferably about 100°, so that the extended end 33 of the foot 31 toes slightly downward. It is further advantageous to bevel the bottom of the foot 31 so that the bottom portion 55 near the extended end 33 is perpendicular to the shank 21. The downward toe and the bevel 55 of the foot 31 brings the eyelets 73 closer to the fabric 67 producing a tighter stitching thereto.

The novel attachment does not require the insertion of the hook (or the eye) into the cavity 35 by pressure. Furthermore, there are no moving parts therein to require servicing or adjustment. The actual insertion and positioning of the hook 71 (or eye) with respect to the stitching needle 61 is done by the magnetic attraction of the magnetic field from the magnet for the hook 71 (or the eye).

One additional problem of prior attachments that is avoided by the novel attachment is the adverse effect of the needle 69 straying from its prescribed path. Occasionally when the needle 60 strayed, and struck the hook 71 (or eye), it pushed down, causing the bottom wall, which was fixedly attached, to burst away from the positioning member 31. Since that portion of the bottom wall is not present in the novel attachment, this cannot happen. With the novel attachment, the needle will deflect from the eyelet 73 before damage can occur. This extends the average life of the attachment.

The novel attachment may include a finger that is pivotally mounted on the foot similar to the structure described in U.S. Pat. No. 3,415,210 to A. Glassman.

I claim:

1. A sewing machine attachment for locating and holding a magnetizable accessory in a predetermined position for sewing comprising (a) a substantially horizontal-extending positioning member having an open cavity therein, at least a portion of the walls of said cavity defining a seat for said accessory (b) and magnetic means within said positioning member for producing a magnetic flux which extends from said seat through the opening of said cavity, characterized in that at least a portion of one wall of said cavity is removably mounted on said positioning member.

2. The attachment defined in claim 1 including a substantially vertically-extending shank portion adapted for attachment to a presser bar on a sewing machine.

3. The attachment defined in claim 1 wherein said cavity is defined by two major substantially-horizontal walls and two minor substantially-vertical walls, and at least a portion of one of said major walls is removably mounted on said positioning member.

4. The attachment defined in claim 3 wherein the lower one of said major walls includes said removably-mounted wall portion.

5. The attachment defined in claim 4 wherein said removably-mounted wall portion is a rectangularly-shaped plate having two opposite sides that are angularly shaped to a dovetail, and said positioning member has two opposed slots therein that are adapted for mating to said dovetailed sides of said plate.

6. The attachment defined in claim 5 wherein said plate is slidably mounted in said slots.

7. The attachment defined in claim 5 wherein said plate has a slit aperture therethrough, said slit aperture being closely spaced from and substantially parallel to one of said opposite sides that is angularly shaped.

* * * * *